US008998381B2

(12) United States Patent
Domae

(10) Patent No.: US 8,998,381 B2
(45) Date of Patent: Apr. 7, 2015

(54) LIQUID JET HEAD AND LIQUID JET APPARATUS

(71) Applicant: SII Printek Inc., Chiba (JP)

(72) Inventor: Yoshinori Domae, Chiba (JP)

(73) Assignee: SII Printek Inc. (JP)

( * ) Notice: Subject to any disclaimer, the term of this patent is extended or adjusted under 35 U.S.C. 154(b) by 0 days.

(21) Appl. No.: 14/103,904

(22) Filed: Dec. 12, 2013

(65) Prior Publication Data

US 2014/0184697 A1 Jul. 3, 2014

(30) Foreign Application Priority Data

Dec. 27, 2012 (JP) ..... 2012-285769

(51) Int. Cl.
*B41J 2/14* (2006.01)
*B41J 2/16* (2006.01)
*B41J 2/045* (2006.01)

(52) U.S. Cl.
CPC ..... *B41J 2/14209* (2013.01); *B41J 2202/12* (2013.01)

(58) Field of Classification Search
None
See application file for complete search history.

(56) References Cited

U.S. PATENT DOCUMENTS

| | | | | |
|---|---|---|---|---|
| 2005/0062786 | A1 | 3/2005 | Makita | 347/20 |
| 2007/0182788 | A1 | 8/2007 | Tanuma | 347/62 |
| 2009/0315957 | A1* | 12/2009 | Koseki | 347/68 |
| 2012/0098897 | A1 | 4/2012 | Suzuki | 347/71 |
| 2013/0063524 | A1* | 3/2013 | Katoh et al. | 347/44 |

FOREIGN PATENT DOCUMENTS

| | | | |
|---|---|---|---|
| EP | 1426185 | | 6/2004 |
| EP | 1815991 | | 8/2007 |
| EP | 2298560 | | 3/2011 |
| JP | 07214796 | A * | 8/1995 |
| JP | 2001277503 | A * | 10/2001 |
| JP | 2003341079 | | 12/2003 |

OTHER PUBLICATIONS

IPO Search Report mailed Jun. 26, 2014 issued in Appln. No. GB1322734.3.

* cited by examiner

*Primary Examiner* — Lisa M Solomon
(74) *Attorney, Agent, or Firm* — Adams & Wilks

(57) ABSTRACT

A liquid jet head includes a nozzle guard attached to a nozzle plate. The nozzle guard functions as a liquid storage unit and is configured to store residual liquid that attaches to the nozzle plate. Channel lines include ejection and non-ejection channels and a dummy channel incapable of driving. Liquid is supplied into the dummy channel while being brought to a negative pressure. The nozzle plate includes a dummy nozzle hole that communicates with the dummy channel, and the dummy nozzle hole is provided at a position to aspirate stored residual liquid using the nozzle guard.

18 Claims, 10 Drawing Sheets

LIQUID JET HEAD AND LIQUID JET APPARATUS

BACKGROUND

1. Technical Field

The present invention relates to a liquid jet head and a liquid jet apparatus.

2. Related Art

A liquid jet recording apparatus including a so-called ink jet type liquid jet head that jets liquid from a plurality of nozzle holes toward a recording medium has conventionally known as an apparatus for recording a character, a graphic, and the like by jetting liquid that is ink or the like on a recoding medium, for example, apiece of recording paper.

There is a known liquid jet head that jets the ink in the ejection channel from the ejection nozzle hole. The liquid jet head includes a nozzle plate having a nozzle line having a plurality of nozzle holes, and an actuator substrate, for example, made of a piezoelectric body and on which a plurality of ejection channels is formed to deform the sidewalls of the ejection channels so as to increase the pressure in the ejection channels by applying a drive voltage to drive electrodes formed on the side surfaces of the sidewalls of the ejection channels.

By the way, apart of the ink ejected from the nozzle hole sometimes remains on the surface of the nozzle plate. The ink remaining on the surface of the nozzle plate causes a problem, for example, a defacement on the surface of the nozzle plate, or a displacement of the direction in which the ink is ejected. This causes the decrease in the print quality of the liquid jet recording apparatus.

To solve the above-mentioned problem, for example, the liquid jet head described in JP 2003-341079 A includes a nozzle plate on which a nozzle hole line having a plurality of nozzle holes that eject the pressurized ink, and a nozzle cover (corresponding to a "nozzle guard" in the appended claim) having an opening at which the nozzle hole line is exposed. The nozzle cover has elasticity and is formed such that at least two sides facing each other around the internal periphery of the opening are warped toward the nozzle plate. Then, the nozzle cover is attached to the surface of the nozzle plate while being pressed so as to reform the warp. The liquid jet head described in JP 2003-341079 A can prevent the wiper blade from floating when the wiper blade wipes the liquid jet head and can also prevent the wiper blade from jumping when the wiper blade goes over an irregularity of the nozzle cover. It is supposed that the wiped ink does not remain near the irregularity of the nozzle cover.

SUMMARY

However, a conventional liquid jet head has an irregularity between the nozzle plate and the nozzle guard although the irregularity is small. The cause of the residual liquid is not radically solved. It is still possible that the liquid remains near the irregularity of the nozzle guard. It is also possible that the liquid enters the gap between the nozzle plate and the nozzle guard and thus the liquid remains in the gap between the nozzle plate and the nozzle guard. Thus, there is a room for improvement to prevent the liquid ejected from the ejection nozzle hole from remaining on the nozzle plate.

In light of the foregoing, an objective of the present invention is to provide a liquid jet head that can stably jet liquid with preventing the liquid from defacement on the nozzle plate due to the residual liquid by preventing the liquid from remaining on the nozzle plate, and a liquid jet apparatus including the liquid jet head.

To solve the problem, the liquid jet head of the present invention includes a nozzle plate having a nozzle line including a plurality of ejection nozzle holes; an actuator substrate on which channel lines including ejection channels communicated with the ejection nozzle holes are formed; and a liquid storage unit configured to store residual liquid attaching to the nozzle plate, wherein the channel lines include a dummy channel that is not capable of driving, liquid is supplied into the dummy channel while being brought to a negative pressure, the nozzle plate includes a dummy nozzle hole communicated with the dummy channel, and the dummy nozzle hole is placed at a position to aspirate the residual liquid stored in the liquid storage unit.

According to the present invention, the liquid is supplied into the dummy channel while being maintained at a negative pressure. This can maintain the inside of the dummy channel at a negative pressure. The liquid jet head of the present invention further includes a dummy nozzle hole communicated with the dummy channel. The dummy nozzle hole is formed at a position to aspirate the residual liquid stored in the liquid storage unit. This can aspirate the residual liquid attaching to the nozzle plate from the dummy nozzle hole into the dummy channel. This can prevent liquid from remaining on the nozzle plate. This can prevent the defacement on the nozzle plate due to the residual liquid and can stably jet the liquid.

The liquid jet head of the present invention further includes a pressure adjustment unit configured to adjust pressure so as to bring the liquid supplied into the ejection channel to a negative pressure, wherein the dummy channel is communicated with the ejection channel such that the liquid is supplied into the dummy channel.

The liquid jet head according to the present invention includes a pressure adjustment unit configured to adjust pressure so as to bring the liquid supplied into the ejection channel to a negative pressure, and the dummy channel is communicated with the ejection channel such that the liquid is supplied into the dummy channel. This can bring the dummy channel to a negative pressure, similarly to the ejection channel. Thus, the shared pressure adjustment unit can bring the liquid in the ejection channel and the dummy channel to a negative pressure such that the residual liquid can be aspirated from the dummy nozzle hole into the dummy channel. This can produce, at a low cost, a liquid jet head that can prevent the defacement on the nozzle plate due to the residual liquid and can stably jet the liquid.

The dummy channels are provided at both ends of the channel lines in a direction in which the channel lines are arranged.

When the channel lines are formed on the actuator substrate, the outer surfaces of the sidewalls of the channels provided at both ends of the channel lines in the direction in which the channel lines are arranged are the outer surfaces of the actuator substrate and are exposed to the outside of the actuator substrate. Thus, drive electrodes are not generally formed on the outer surfaces of the sidewalls of the channels provided on both ends in the direction in which the channel lines are arranged. As a result, the channels provided at both ends of the channel lines are incapable of driving. According to the present invention, designing conventionally existing channels incapable of driving as the dummy channels can form the dummy channel and the dummy nozzle hole communicated with the dummy channel without a complicated design change, process, or the like. This can produce, at a low cost, a liquid jet head that can prevent liquid from remaining on the nozzle plate.

A plurality of the dummy channels is provided at each of the ends of the channel lines in a direction in which the channel lines are arranged.

According to the present invention, a plurality of dummy nozzle holes communicated with the dummy channel can be formed on the nozzle plate such that the residual liquid attaching to the nozzle plate can be aspirated from the dummy nozzle holes into the dummy channels.

The dummy nozzle hole has almost an identical diameter to the ejection nozzle hole.

According to the present invention, the ejection nozzle holes and the dummy nozzle holes can be formed in the same process. This can easily produce, at a low cost, a liquid jet head that can prevent liquid from remaining on the nozzle plate.

The liquid storage unit is provided on a liquid ejection surface of the nozzle plate, and is a nozzle guard in which a slit configured to expose at least the ejection nozzle hole is formed.

According to the present invention, using the nozzle guard as a liquid storage unit can prevent the damage to the liquid ejection surface of the nozzle plate and can store the residual liquid such that the residual liquid can be aspirated from the dummy nozzle holes into the dummy channels. This can produce a liquid jet head that can prevent liquid from remaining on the nozzle plate and is good in durability.

The nozzle guard is provided so as to cover the dummy nozzle hole.

According to the present invention, since the nozzle guard is provided so as to cover the dummy nozzle hole, it can make the slight gap between the nozzle guard and the nozzle plate being a negative pressure chamber and can aspirate the residual liquid from the dummy nozzle hole. This can surely prevent liquid from remaining, specifically, at between the nozzle guard and the nozzle plate.

The slit of the nozzle guard is formed so as to expose the dummy nozzle hole.

The present invention can surely prevent liquid from remaining in the slit of the nozzle guard.

An edge of the slit of the nozzle guard is placed on an edge of the dummy nozzle hole.

According to the present invention, placing the edge of the slit of the nozzle guard on the edge of the dummy nozzle hole can surely aspirate the residual liquid attaching to the edge of the slit of the nozzle guard from the dummy nozzle hole. This can surely prevent the liquid from remaining in the slit. Especially, providing a wiper that wipes the residual liquid with scanning through the liquid ejection surface of the nozzle plate causes the residual liquid wiped by the wiper to be likely to attach to the edge of the slit. Thus, the present configuration in which the edge of the slit of the nozzle guard is placed on the dummy nozzle hole is especially advantageous to a liquid jet head including a wiper.

The nozzle guard is made of stainless steel.

Generally, stainless steel is hydrophilic. According to the present invention, making the nozzle guard of stainless steel can cause the residual liquid to spread and move on the surface of the nozzle guard. This can prevent liquid from remaining on the nozzle plate and the nozzle guard, and easily aspirate the residual liquid from the dummy nozzle hole into the dummy channel.

The liquid storage unit is an introduction groove formed on the nozzle plate and connected to the dummy nozzle hole.

According to the present invention, using the introduction groove formed on the nozzle plate as a liquid storage unit can form the liquid storage units without using a new component. Using the introduction groove connected to the dummy nozzle hole as a liquid storage unit can easily store the residual liquid and can surely cause the dummy nozzle hole to aspirate the residual liquid.

The liquid jet head of the present invention further includes a second liquid storage unit that is an introduction groove formed on at least one of the nozzle plate and the nozzle guard, and connected to the dummy nozzle hole.

The present invention includes, as the second liquid storage unit, an introduction groove formed on at least one of the nozzle plate and the nozzle guard, and connected to the dummy nozzle hole. This can more surely collect and store a large amount of residual liquid. This can surely cause the dummy nozzle hole to aspirate a large amount of residual liquid.

The nozzle plate is made of a polyimide-based resin material.

Generally, a polyimide-based resin material is water-repellent. According to the present invention, making the nozzle plate of a polyimide-based resin material can cause the residual liquid to easily move on the surface of the nozzle plate. This can prevent liquid from remaining on the surface of the nozzle plate, and can easily aspirate the residual liquid from the dummy nozzle hole into the dummy channel.

The liquid is supplied from a first longitudinal side of the dummy channel and is discharged from a second longitudinal side of the dummy channel so as to circulate in the dummy channel, and the dummy nozzle hole is placed at a longitudinal middle portion of the dummy channel.

According to the present invention, placing the dummy nozzle hole at a longitudinal middle portion of the dummy channel can place the dummy nozzle hole at the longitudinal middle portion of the nozzle plate. This can aspirate the residual liquid attaching to the surface of the nozzle plate from the dummy nozzle hole in a fine balance.

The liquid is supplied from a first longitudinal side of the dummy channel and is discharged from a second longitudinal side of the dummy channel so as to circulate in the dummy channel, and the dummy nozzle hole is placed on the second longitudinal side away from a longitudinal middle portion of the dummy channel.

In a so-called flow-through type liquid jet head in which liquid is supplied from a first longitudinal side of the channel and is discharged from a second longitudinal side, the liquid is brought to a positive pressure on a supply side of the liquid (the first longitudinal side) and is brought to a negative pressure on a discharge side of the liquid (second longitudinal side) in the channel so as to circulate in the channel. According to the present invention, placing the dummy nozzle hole on the second longitudinal side away from the longitudinal middle portion of the dummy channel, in other words, on the side on which the liquid at a negative pressure is discharged can provide a higher suction. This can aspirate the residual liquid from the dummy nozzle hole into the dummy channel.

The ejection channels and non-ejection channels that are alternately arranged form the channel lines.

The present invention is suitable for a liquid jet head in which ejection channels and non-ejection channels that are alternately arranged.

The surface of the nozzle plate is rendered water-repellent.

The present invention can cause the residual liquid to easily move on the surface of the nozzle plate. This can easily aspirate the residual liquid from the dummy nozzle hole into the dummy channel.

The surface of the nozzle plate is rendered hydrophilic.

The present invention can cause the residual liquid to spread and move on the surface of the nozzle plate. This can easily aspirate the residual liquid from the dummy nozzle hole into the dummy channel.

Further, a liquid jet apparatus according to an embodiment of the present invention includes a movement mechanism configured to relatively move the liquid jet head and a recording medium; a liquid supply tube configured to supply liquid to the liquid jet head; and a liquid tank configured to supply the liquid to the liquid supply tube.

The present invention includes a liquid jet head that can stably jet liquid with preventing the residual liquid from defacing the nozzle plate by preventing the liquid from remaining on the nozzle plate and thus can provide a high-performance liquid jet apparatus with a good print quality.

According to the present invention, the liquid is supplied into the dummy channel while being maintained at a negative pressure. This can maintain the inside of the dummy channel at a negative pressure. The liquid jet head of the present invention further includes a dummy nozzle hole communicated with the dummy channel. The dummy nozzle hole is formed at a position to aspirate the residual liquid stored in the liquid storage unit. This can aspirate the residual liquid attaching to the nozzle plate from the dummy nozzle hole into the dummy channel. This can prevent liquid from remaining on the nozzle plate. This can prevent the defacement on the nozzle plate due to the residual liquid and can stably jet the liquid.

DETAILED DESCRIPTION

Hereinafter, the embodiments of the present invention will be described with reference to the appended drawings. Note that, hereinafter, a liquid jet apparatus according to the embodiments will be described first, and a liquid jet head according to the embodiments will subsequently be described.

Figure 1:
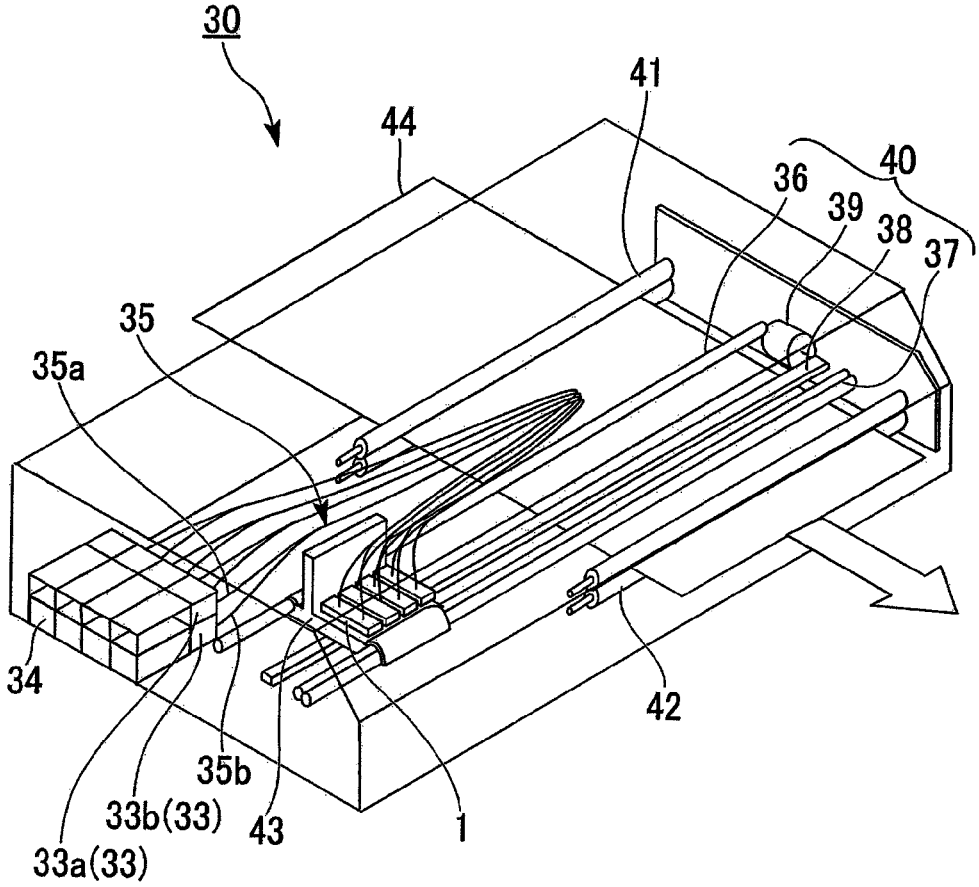
FIG. 1 is a diagram for describing a liquid jet apparatus according to an embodiment.
Figure 2:
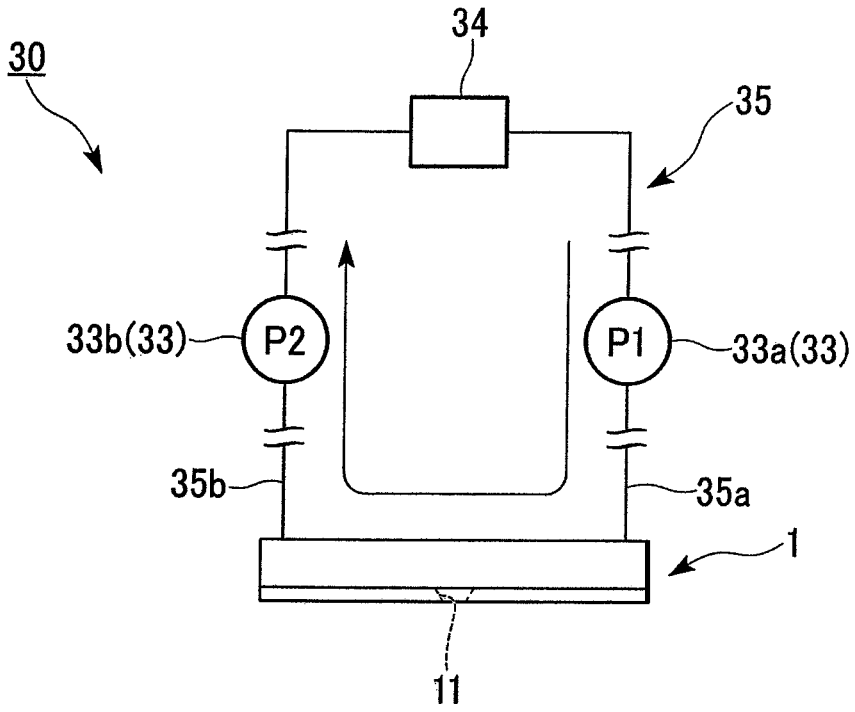
FIG. 2 is a diagram for describing the liquid jet head and a pressure adjustment unit according to the embodiment.

FIG. 1 is a diagram for describing a liquid jet apparatus 30 according to an embodiment. FIG. 2 is a diagram for describing a liquid jet head 1 and a pressure adjustment unit 33 (corresponding to the "pressure adjustment unit" in the appended claim) according to the embodiment.

As illustrated in FIG. 1, the liquid jet apparatus 30 includes a plurality of (four in the present embodiment) liquid jet heads 1 that jet liquid including ink from an ejection nozzle hole 11 (see FIG. 2) communicated with an ejection channel (not illustrated in the drawings), a circulation flow path 35 having a liquid supply pipe 35*a* that supplies liquid to the liquid jet head 1 and a liquid discharge pipe 35*b* that discharges the liquid from the liquid jet head 1, the pressure adjustment unit 33 having a pressurization pump 33*a* that brings the liquid to a positive pressure to supply the liquid to the liquid jet head 1 through the liquid supply pipe 35*a* and an aspiration pump 33*b* that brings the liquid to a negative pressure to discharge the liquid from the liquid jet head 1 through the liquid discharge pipe 35*b*, and a plurality of (four in the present embodiment) liquid tanks 34 that houses the liquid supplied to and discharged from the liquid jet head 1.

Note that the positive pressure and the negative pressure can be determined based on the fact that the pressure is greater or lower than the atmospheric pressure, or based on the fact that the pressure is greater or lower than the pressure of any of the liquid on the liquid flow path including the liquid tanks.

The liquid jet apparatus 30 further includes a pair of convey units 41 and 42 that convey a recording medium 44, for example, a piece of paper in a main scanning direction, a carriage unit 43 that places the liquid jet head 1 thereon, a moving mechanism 40 that scans the liquid jet head 1 in a vertical scanning direction perpendicular to the main scanning direction. A control unit (not illustrated in the drawings) controls the liquid jet head 1, the moving mechanism 40, and the convey units 41 and 42 to drive them. In some cases, a pressure sensor or a flow rate sensor (not illustrated in the drawings) is installed on the control unit in order to control the flow rate or pressure of the liquid.

The pair of convey units 41 and 42 extends in the sub-scanning direction and has grid rollers and pinch rollers that rotate with the roller surfaces thereof coming in contact with each other. The grid rollers and the pinch rollers are caused to rotate about the shafts thereof by a motor (not shown) to convey the recording medium 44 held between the rollers in the main scanning direction. The moving mechanism 40 includes a pair of guide rails 36 and 37 that extend in the sub-scanning direction; the carriage unit 43 slidable along the pair of guide rails 36 and 37; an endless belt 38 that is connected to the carriage unit 43 and moves the carriage unit 43 in the sub-scanning direction; and a motor 39 that revolves the endless belt 38 via pulleys (not shown).

The carriage unit 43 places the liquid jet heads 1 thereon so as to eject, for example, four types of liquid yellow, magenta, cyan, and black.

The liquid tanks 34 each can store the liquid of an appropriate color. As illustrated in FIG. 2, the liquid tanks 34 store the liquid supplied to the liquid jet head 1 and discharged from the liquid jet head 1.

The pressurization pump 33*a* pressurizes the liquid in the liquid supply pipe 35*a* of the circulation flow path 35 to send the liquid into the ejection channel of the liquid jet head 1 through the liquid supply pipe 35*a*. This brings the liquid flowing on the liquid supply pipe 35*a* side in the ejection channel of the liquid jet head 1 to a positive pressure. The aspiration pump 33*b* reduces the pressure of the liquid in the liquid discharge pipe 35*b* of the circulation flow path 35 to aspirate the liquid from the ejection channel of the liquid jet head 1. This brings the liquid flowing on the liquid discharge pipe 35*b* side in the ejection channel of the liquid jet head 1 to a negative pressure. Thus, the liquid can circulate between the liquid jet head 1 and the liquid tank 34 through the circulation flow path 35 using the pressurization pump 33*a* and the aspiration pump 33*b*. In other words, a so-called flow-through type liquid jet head is used as the liquid jet head 1 in the embodiment.

In that case, the suction of the aspiration pump 33*b* is set higher than the pressurizing force of the pressurization pump 33*a*. This adjusts the liquid flowing in the ejection channel of the liquid jet head 1 near the ejection nozzle hole 11 such that the liquid is constantly maintained at a negative pressure before and after the jet of the liquid. In other words, the pressurization pump 33*a* and the aspiration pump 33*b* are included in the pressure adjustment unit 33 that adjusts the pressure of the liquid supplied to the ejection channel of the liquid jet head 1 to maintain the liquid at a negative pressure.

Each of the liquid jet heads 1 ejects each color of liquid in response to a drive signal. Controlling the timings to eject liquid from the liquid jet heads 1, the rotation of the motor 39 that drives the carriage unit 43, and the convey velocity of the recording medium 44 can record an arbitrary pattern on the recording medium 44.

Note that in the liquid jet apparatus 30 according to the fifth embodiment, the moving mechanism 40 moves the carriage unit 43 and the recording medium 44 to perform recording. Alternatively, a liquid jet apparatus may be used in which a moving mechanism two-dimensionally moves a recording medium to perform recording with a carriage unit fixed. In other words, any moving mechanism that relatively moves the liquid jet head 1 and a recording medium can be used.

Liquid Jet Head of First Embodiment

Next, the liquid jet head 1 according to the first embodiment will be described.

Figure 3:
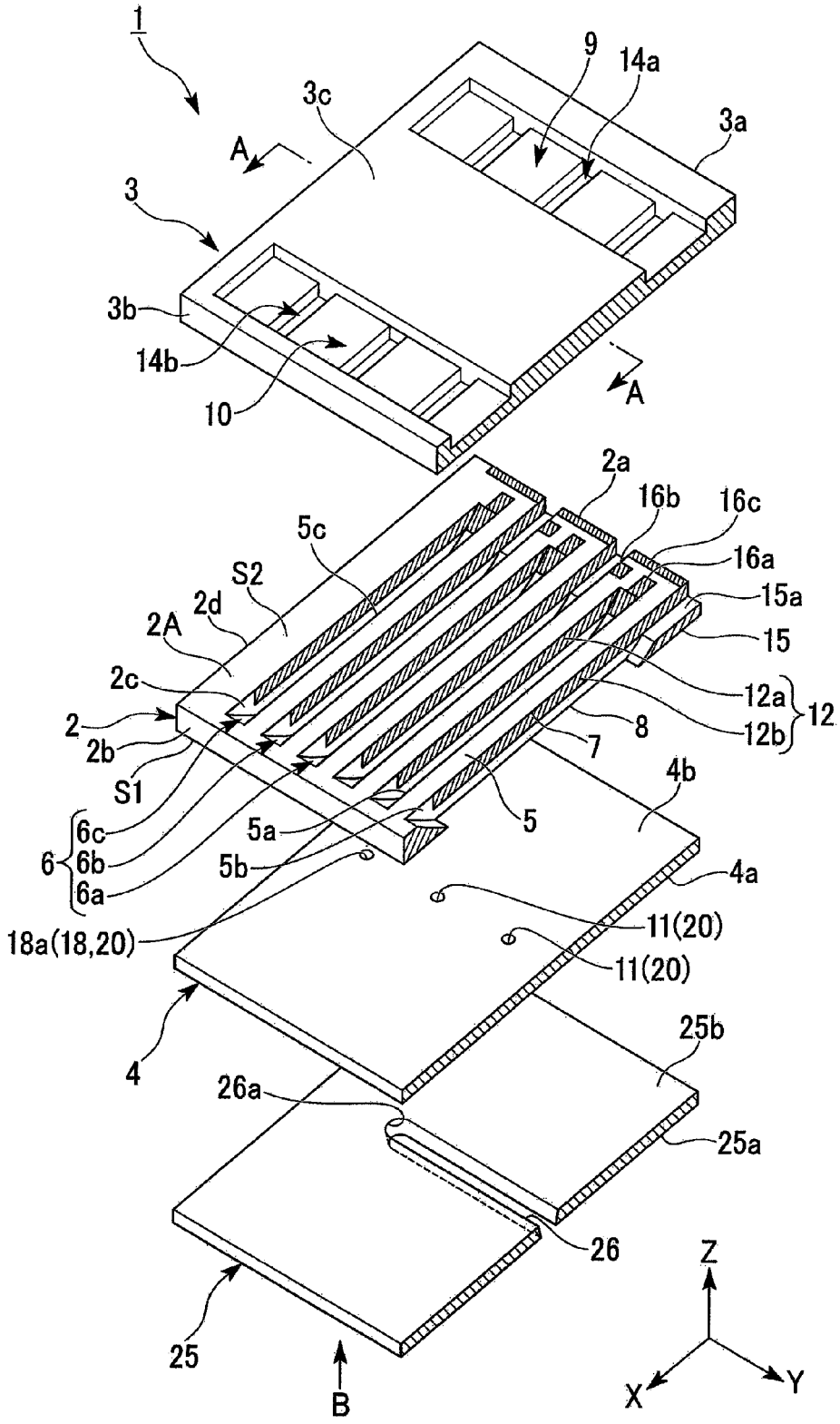
FIG. 3 is an exploded perspective view of the liquid jet head according to the present embodiment.

FIG. 3 is an exploded perspective view of the liquid jet head 1 according to the present embodiment.

Figure 4A:
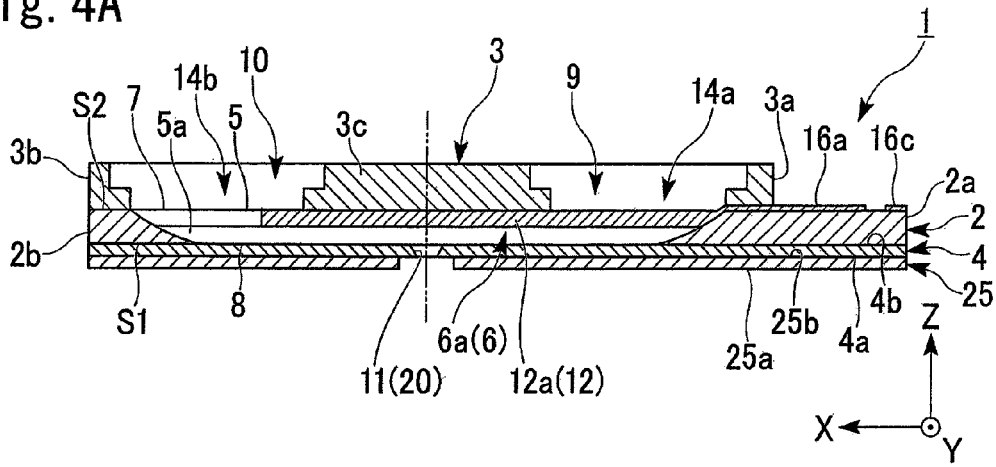
FIGS. 4A to 4C are diagrams for describing the liquid jet head according to the embodiment.
Figure 4B:
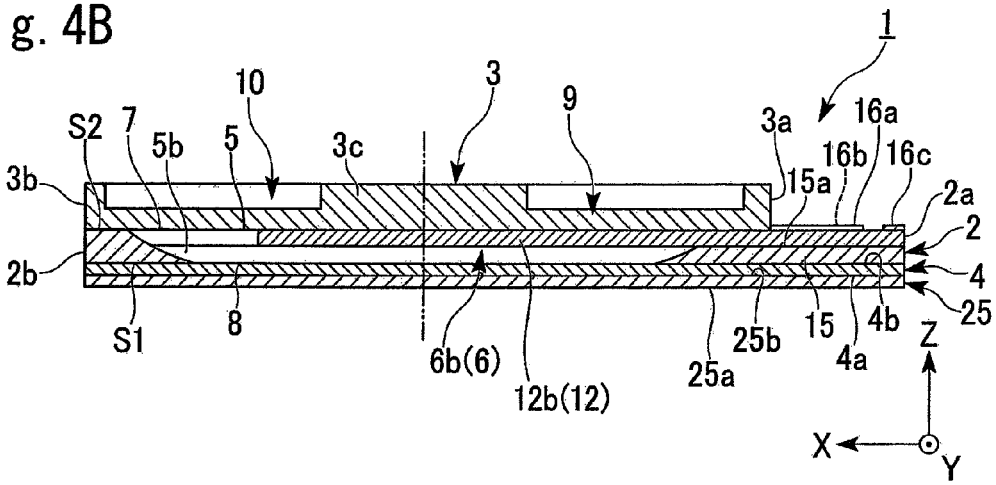
Figure 4C:
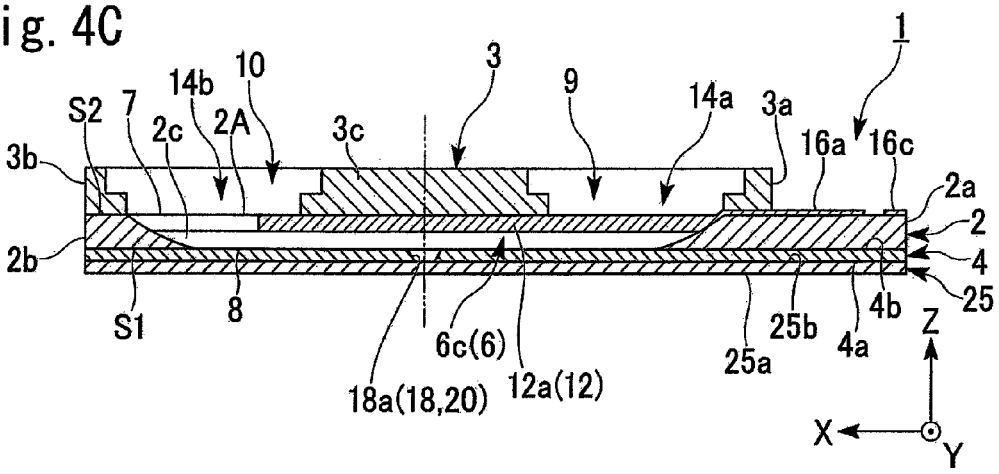

FIGS. 4A to 4C are diagrams for describing the liquid jet head 1 according to the embodiment. FIG. 4A is a cross-sectional view taken along the longitudinal direction of an ejection channel 6*a*. FIG. 4B is a cross-sectional view taken along the longitudinal direction of a non-ejection channel 6*b*. FIG. 4C is a cross-sectional view taken along the longitudinal direction of a dummy channel 6*c*. Note that, for simplicity's sake, drive electrodes 12 are represented by hatching in FIGS. 3 and 4A to 4C.

Figure 5:
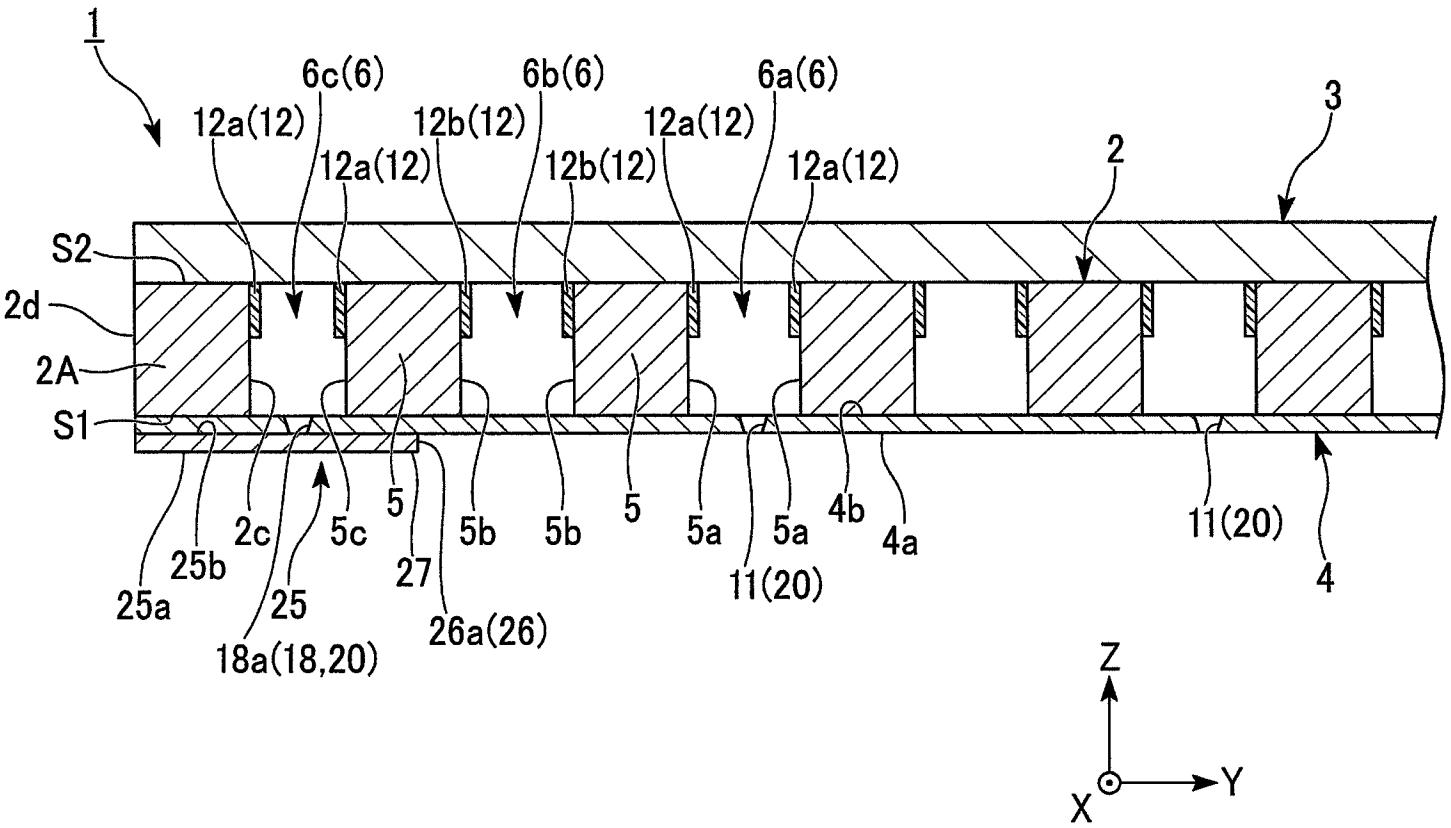
FIG. 5 is a cross-sectional view taken along line A-A of FIG. 3.

FIG. 5 is a cross-sectional view taken along line A-A of FIG. 3.

As illustrated in FIG. 3, the liquid jet head 1 in the first embodiment includes an actuator substrate 2, a cover plate 3, a nozzle plate 4, and a nozzle guard 25.

The actuator substrate 2 is divided with a wall portion 5 made of a piezoelectric body and includes channel lines 6 penetrating a first main surface S1 and a second main surface S2 and including a plurality of the ejection channels 6*a*, the non-ejection channels 6*b*, and the dummy channels 6*c*.

The cover plate 3 is installed on the actuator substrate 2 so as to cover an opening 7 on the second main surface S2 side of the channel lines 6. The cover plate 3 includes a liquid supply chamber 9 on a first longitudinal side of each of the channels 6*a*, 6*b*, and 6*c*, and a liquid discharge chamber 10 on a second longitudinal side of each of the channels 6*a*, 6*b*, and 6*c*. The liquid supply chamber 9 is configured to supply liquid to the ejection channel 6*a* and the dummy channel 6*c*. The liquid discharge chamber 10 is configured to discharge liquid from the ejection channel 6*a* and the dummy channel 6*c*.

The nozzle plate 4 includes the ejection nozzle hole 11 communicated with the ejection channel 6*a* and a dummy nozzle hole 18 communicated with the dummy channel 6*c*. The nozzle plate 4 is installed on the actuator substrate 2 so as to cover an opening 8 on the first main surface S1 side of the channel lines 6.

Note that, hereinafter, the longitudinal direction in which each of the channels 6*a*, 6*b*, and 6*c* extends is referred to as an X direction. A first side on which the liquid supply chamber 9 is placed is referred to as a −X side. A second side on which the liquid discharge chamber 10 is placed is referred to as a +X side. The direction in which the channel lines 6 are arranged and perpendicular to the longitudinal direction is referred to as a Y direction. The left side on the paper of FIG. 3 is referred to as a −Y side. The right side on the paper of FIG. 3 is referred to as a +Y side. The direction perpendicular to the X direction and the Y direction is referred to as a Z direction. The first main surface S1 side is referred to as a −Z side. The second main surface S2 side is referred to as a +Z side. Hereinafter, the orthogonal coordinate system of the X, Y, and Z is used in the description as necessary.

Actuator Substrate

Hereinafter, each component of the liquid jet head 1 will be described in detail.

The actuator substrate 2 is formed into an approximately rectangular plate with a piezoelectric material, for example, PZT ceramics that is polarized in the Z direction.

The channel lines 6 on the actuator substrate 2 are the ejection channels 6*a*, the non-ejection channels 6*b*, and the dummy channels 6*c*. The ejection channels 6*a* and the non-ejection channels 6*b* are alternately arranged in the Y direction. The dummy channels 6*c* (only the dummy channel 6*c* on the −Y side is illustrated in FIG. 3) are placed on both sides of the channel lines 6 in the Y direction one by one.

Ejection Channel

As illustrated in FIG. 4A, each of the −X side end and the +X side end of the ejection channel 6*a* inclines as turning up from the −Z side (the first main surface S1 side) to the +Z side (the second main surface S2 side) of the actuator substrate 2. The ejection channel 6*a* is formed between a position biased toward the +X side from a −X side end 2*a* of the actuator substrate 2 and a −X side end 3*a* of the cover plate 3, and a position biased toward the −X side from a +X side end 2*b* of the actuator substrate 2.

As illustrated in FIG. 5, common electrodes 12*a* are formed as the drive electrodes 12 on the side surfaces 5*a* and 5*a* of a pair of wall portions 5 and 5 facing the ejection channel 6*a*. As illustrated in FIG. 4A, the common electrodes 12*a* are formed into an approximate band shape and extend in the X direction from the −X side ends of the side surfaces 5*a* and 5*a* of a pair of the wall portions 5 and 5 of the ejection channel 6*a* to a position biased toward the −X side from a +X side end. As illustrated in FIG. 3, a pair of the common electrodes 12*a* and 12*a* formed on the side surfaces 5*a* and 5*a* of the ejection channel 6*a* are electrically connected to each other.

Non-Ejection Channel

As illustrated in FIG. 4B, the +X side end of the non-ejection channel 6*b* inclines as turning up from the −Z side to the +Z side of the actuator substrate 2 in the same manner as the ejection channel 6*a*. The −X side end of the non-ejection channel 6*b* extends to the −X side end 2*a* of the actuator substrate 2. A raised bottom 15 that is the remaining actuator substrate 2 is formed on the bottom of the non-ejection channel 6*b* near the −X side end 2*a*. A +Z side surface 15*a* of the raised bottom 15 is formed approximately parallel to the first main surface S1 with being placed on the +Z side away from the first main surface S1. The raised bottom 15 inclines as turning up from the −Z side to the +Z side while being continuously formed toward the +Z side surface 15*a* of the raised bottom 15.

As illustrated in FIG. 5, active electrodes 12*b* are formed as the drive electrodes 12 on the side surfaces 5*b* and 5*b* of a pair of wall portions 5 and 5 facing the non-ejection channel 6*b*. As illustrated in FIG. 4B, the active electrodes 12*b* are formed into an approximate band shape and extend in the X direction from the −X side ends of the side surfaces 5*a* and 5*a* of a pair of the wall portions 5 and 5 of the non-ejection channel 6*b* to a position biased toward the −X side from a +X side end. As illustrated in FIG. 3, a pair of the active electrodes 12*b* and 12*b* formed on the side surfaces 5*b* and 5*b* of the non-ejection channel 6*b* are electrically separated from each other.

Dummy Channel

As illustrated in FIG. 5, a dummy channel 6*c* is formed of the wall portion 5 placed on the inner side in the Y direction (the +Y side in FIG. 5), and an outer wall 2A of the actuator substrate 2 placed on the outer side in the Y direction (the −Y side in FIG. 5). As illustrated in FIG. 4C, the dummy channel 6*c* has the same shape as the ejection channel 6*a* (see FIG. 4A). Thus, the detailed description is omitted.

As illustrated in FIG. 5, common electrodes 12*a* are formed on a side surface 5*c* of the wall portion 5 and an inner surface 2*c* of the outer wall 2A that face the dummy channel 6*c*. The common electrodes 12*a* are formed into an approximate band shape and extend in the X direction from the −X side ends of the side surface 5*c* of the wall portion 5 and the inner surface 2*c* of the outer wall 2A facing the dummy channel 6*c* to a position biased toward the −X side from a +X side end. A pair of the common electrodes 12*a* and 12*a* formed on the side surface 5*c* of the wall portion 5 and the inner surface 2*c* of the outer wall 2A of the dummy channel 6*c* are electrically connected to each other.

The outer surface of the outer wall 2A forming the dummy channel 6*c* corresponds to an outer surface 2*d* of the actuator substrate 2 and is exposed to the outside of the actuator substrate 2. Thus, a drive electrode 12 is not formed on the outer surface 2*d* of the actuator substrate 2 in consideration of a damage or the like.

As illustrated in FIG. 3, a common terminal 16*a* electrically connected to the common electrode 12*a*, an active terminal 16*b* electrically connected to the active electrode 12*b*, and a wiring 16*c* electrically connecting the active electrodes 12*b* formed at adjoining non-ejection channels 6*b* are installed in an area on the −X side of the second main surface S2 of the actuator substrate 2.

The common terminal 16*a* and the active terminal 16*b* each are a land connected to a wiring electrode on a flexible substrate or the like (not illustrated in the drawings). The active terminal 16*b* is electrically connected to the active electrode 12*b* formed on the side surface 5*b* that faces the non-ejection channel 6*b* on a first wall portion 5 (on the −Y side in the present embodiment) of a pair of the wall portions 5 and 5 that place the ejection channel 6*a* therebetween. The active terminal 16*b* is electrically connected through the wiring 16*c* formed along an edge of the −X side end 2*a* of the actuator substrate 2 to the active electrode 12*b* formed on the side surface 5*b* that faces the non-ejection channel 6*b* on a second wall portion 5 (on the +Y side in the present embodiment) of the wall portion 5.

In the actuator substrate 2 having the formation described above, each of a pair of wall portions 5 and 5 forming an ejection channel 6*a* includes a common electrode 12*a* on the side surface 5*a* on the ejection channel 6*a* side, and includes an active electrode 12*b* on the side surface 5*b* on the non-ejection channel 6*b* side. The common electrode 12*a* and the active electrodes 12*b* hold a wall portion 5 therebetween. Thus, applying a drive voltage to the common electrodes 12*a* and the active electrodes 12*b* through the common terminals 16*a* and the active terminals 16*b* can generate an electric field in the wall portion 5. This can deform each of a pair of wall portions 5 and 5 forming an ejection channel 6*a* by thickness shear deformation. Thus, the ejection channel 6*a* can be driven.

On the other hand, in a wall portion 5 placed on the +Y side and the outer wall 2A placed on the −Y side that form the dummy channel 6*c*, the outer surface 2*d* does not include an electrode thereon although the outer wall 2A includes a common electrode 12*a* on the inner surface 2*c* on the dummy channel 6*c* side. Thus, an electric field cannot be generated in the outer wall 2A even if a drive voltage is applied to the common electrodes 12*a* and the active electrodes 12*b* through the common terminals 16*a* and the active terminals 16*b*. As a result, the outer wall 2A forming the dummy channel 6*c* cannot be deformed by thickness shear deformation. Thus, the dummy channel 6*c* is incapable of driving.

Cover Plate

The cover plate 3 is formed into an approximately rectangular plate and of, for example, PZT ceramics that is the same material as the actuator substrate 2. Note that the material forming the cover plate 3 is not limited to the PZT ceramics. For example, machinable ceramics, other ceramics, or low dielectric materials including glass can be used. However, forming the cover plate 3 and the actuator substrate 2 of the same material can equalize the thermal expansions of the cover plate 3 and the actuator substrate 2. This can prevent the warp or deformation of the liquid jet head 1 in response to temperature change.

As illustrated in FIGS. 4A to 4C, the cover plate 3 includes the liquid supply chamber 9 on the −X side of the actuator substrate 2, the liquid discharge chamber 10 on the +X side, and a body portion 3*c* between the liquid supply chamber 9 and the liquid discharge chamber 10. The cover plate 3 is placed so as to cover the ejection channels 6*a*, the non-ejection channels 6*b*, and the dummy channels 6*c*. The cover plate 3 is bonded and fixed to the second main surface S2 of the actuator substrate 2, for example, using an adhesive agent. At that time, as illustrated in FIG. 4A, the +Z side end in an area corresponding to the body portion 3*c* of the cover plate 3 in the wall portion 5 forming the ejection channel 6*a* coheres with and is strongly fixed to the body portion 3*c* of the cover plate 3.

As illustrated in FIGS. 4A to 4C, the X direction length of the cover plate 3 is shorter than the X direction length of the actuator substrate 2. The cover plate 3 is placed such that the +X side end 3*b* is approximately flush with the +X side end 2*b* of the actuator substrate 2, and the −X side end 3*a* is placed on the +X side away from the −X side 2*a* of the actuator substrate 2. Thus, the common terminal 16*a*, the active terminal 16*b*, and the wiring 16*c* are exposed to the outside at an area on the −X side away from the −X side end 3*a* of the cover plate 3 on the second main surface S2 of the actuator substrate 2 and thus the flexible substrate or the like (not illustrated in the drawings) is connectable thereto.

As illustrated in FIG. 3, the liquid supply chamber 9 includes a plurality of first slits 14*a* on the bottom. The first slits 14*a* are formed by penetrating the positions correspond to the ejection channels 6*a* and the dummy channels 6*c* on the bottom of the liquid supply chamber 9 in the Z direction. The first slits 14*a* extend in the X direction. The first slits 14*a* are arranged in the Y direction. As illustrated in FIG. 4A, the liquid supply chamber 9 is communicated with the −X side end of the ejection channel 6*a* through the first slit 14*a*. As illustrated in FIG. 4C, the liquid supply chamber 9 is also communicated with the −X side end of the dummy channel 6*c* through the first slit 14*a*. In other words, the −X side end of the ejection channel 6*a* and the −X side end of the dummy channel 6*c* are communicated with each other through the first slits 14*a* and the liquid supply chamber 9. Note that the liquid supply chamber 9 is not communicated with the non-ejection channel 6*b* (see FIG. 4B).

As illustrated in FIG. 3, the liquid discharge chamber 10 includes a plurality of second slits 14*b* on the bottom. The second slits 14*b* are formed by penetrating the positions correspond to the ejection channels 6*a* and the dummy channels 6*c* on the bottom of the liquid discharge chamber 10 in the Z direction. The second slits 14*b* extend in the X direction. The second slits 14*b* are arranged in the Y direction. As illustrated in FIG. 4A, the liquid discharge chamber 10 is communicated with the +X side end of the ejection channel 6*a* through the second slit 14*b*. As illustrated in FIG. 4C, the liquid discharge chamber 10 is also communicated with the +X side end of the dummy channel 6*c* through the second slits 14*b*. In other words, the +X side end of the ejection channel 6*a* and the +X side end of the dummy channel 6*c* are communicated with each other through the second slits 14*b* and the liquid discharge chamber 10. Note that the liquid discharge chamber 10 is not communicated with the non-ejection channel 6*b* (see FIG. 4B).

The cover plate 3 preferably has a thickness, for example, of 0.3 to 1.0 mm. The cover plate 3 having a thickness less than 0.3 mm reduces the strength. The cover plate 3 having a thickness more than 1.0 mm increases the time required to process the liquid supply chamber 9, the liquid discharge chamber 10, the first slits 14*a*, the second slits 14*b*, and the like, and increases the cost due to the increase in the used amount of the materials.

As illustrated in FIG. 3, the pressurization pump 33*a* (see FIG. 2) pressurizes the liquid in the liquid tank 34 (see FIG. 2) such that the liquid is supplied to the liquid supply chamber 9. Then, the liquid flows into the ejection channel 6*a* and the dummy channel 6*c* through the first slit 14*a*. Thus, the pressure of the liquid flowing in the ejection channel 6*a* and the dummy channel 6*c* in the liquid jet head 1 has a positive pressure on the liquid supply chamber 9 side.

The aspiration pump 33*b* (see FIG. 2) reduces the pressure of the liquid in the ejection channel 6*a* and the dummy channel 6*c* such that the liquid is discharged from the liquid discharge chamber 10 through the second slit 14*b*. Then, the liquid flows into the liquid tank 34 (see FIG. 2). Thus, the pressure of the liquid flowing in the ejection channel 6*a* and the dummy channel 6*c* in the liquid jet head 1 has a negative pressure on the liquid discharge chamber 10 side. Bringing the liquid in the ejection channel 6*a* and the dummy channel 6*c* to a negative pressure sets the suction of the aspiration pump 33*b* (see FIG. 2) higher than the pressurizing force of the pressurization pump 33*a* (see FIG. 2).

Nozzle Plate

The nozzle plate 4 is a component formed into a thin film made of a synthetic resin material, for example, polyimide, or polypropylene, or a metallic material. The nozzle plate 4 is formed into an approximately rectangle corresponding to the external form of the actuator substrate 2 when being viewed in the Z direction.

A +Z side surface 4*b* of the nozzle plate 4 is bonded and fixed to the first main surface S1 of the actuator substrate 2, for example, with an adhesive agent such that the nozzle plate 4 covers the first openings 8 of the ejection channel 6*a*, the non-ejection channel 6*b*, and the dummy channel 6*c* on the first main surface S1 side.

As illustrated in FIG. 4A, the nozzle plate 4 includes the ejection nozzle hole 11 communicated with the ejection channel 6*a* at the middle portion of the ejection channel 6*a* in the X direction. A −Z side surface of the nozzle plate 4 is a liquid ejection surface 4*a* on which the liquid is ejected from the ejection nozzle hole 11. The ejection nozzle hole 11 gradually decreases in diameter from the +Z side surface 4*b* of the nozzle plate 4 to the liquid ejection surface 4*a* on the −Z side. The liquid flowing in the ejection channel 6*a* is adjusted near the ejection nozzle hole 11 by the pressure adjustment unit 33 (see FIG. 2) such that the liquid is constantly maintained at a negative pressure before and after the jet of the liquid. This stably forms the shape of the upper surface of the liquid (meniscus) at the opening of the ejection nozzle hole 11. Thus, the liquid in the ejection channel 6*a* can stably be jetted.

As illustrated in FIG. 4C, the nozzle plate 4 includes the dummy nozzle hole 18 communicated with the dummy channel 6*c* at the middle portion of the dummy channel 6*c* in the X direction. The dummy nozzle hole 18 gradually decreases in diameter from the +Z side to the −Z side. In that case, the dummy channel 6*c* is communicated with the ejection channel 6*a* as described above. Thus, the liquid flowing in the dummy channel 6*c* is adjusted near the dummy nozzle hole 18 by the pressure adjustment unit 33 (see FIG. 2) in a similar manner to the ejection channel 6*a* such that the liquid is constantly maintained at a negative pressure.

Figure 6:
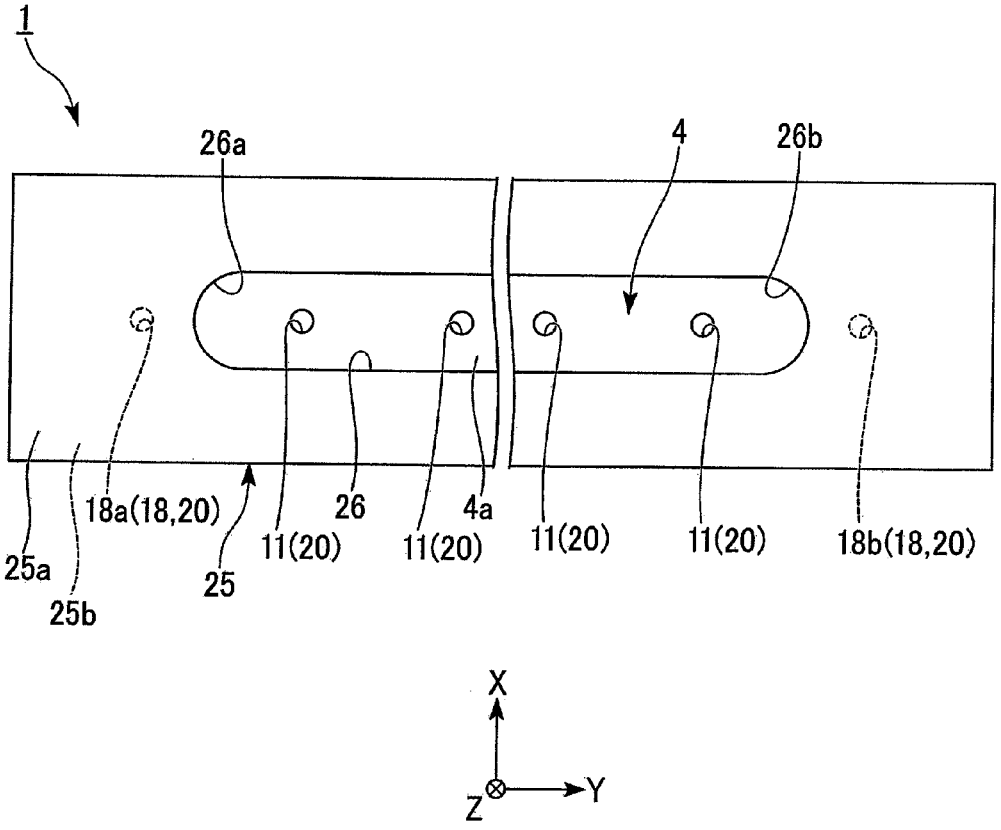
FIG. 6 is a diagram viewed on Arrow B in FIG. 3.

FIG. 6 is a diagram viewed on Arrow B in FIG. 3.

As illustrated in FIG. 6, the ejection nozzle holes 11 and the dummy nozzle holes 18 that are arranged in the Y direction form a nozzle line 20. In the present embodiment, the dummy nozzle holes 18 (the dummy nozzle hole 18*a* on the −Y side and the dummy nozzle hole 18*b* on the +Y side) are provided at both ends in the Y direction. A plurality of ejection nozzle holes 11 are provided between the dummy nozzle holes 18*a* and 18*b* formed at both of the ends in the Y direction. This forms the nozzle line 20.

Note that the positional relationship between the nozzle line 20 including the ejection nozzle holes 11 and the dummy nozzle holes 18*a* and 18*b*, and the nozzle guard 25 will be described in detail below.

In the present embodiment, the ejection nozzle holes 11 have the same shape as the dummy nozzle holes 18*a* and 18*b*. The ejection nozzle holes 11 and the dummy nozzle holes 18*a* and 18*b* are formed on the −Z side surface of the nozzle plate 4 with having almost the same diameters. Thus, ejection nozzle holes 11 and the dummy nozzle holes 18*a* and 18*b* can be formed in the same process.

The nozzle plate 4 preferably has a thickness, for example, 0.01 to 0.1 mm. The nozzle plate 4 having a thickness less than 0.01 mm reduces the strength. The nozzle plate 4 having a thickness more than 0.1 mm transfers the vibration to the ejection nozzle holes 11 and the dummy nozzle holes 18*a* and 18*b* adjoining to each other and thus facilitates a crosstalk.

At that case, the PZT ceramics have a Young's modulus of 58.48 GPa and the polyimide has a Young's modulus of 3.4 GPa. Thus, using the PZT ceramics as the cover plate 3 and using a polyimide film as the nozzle plate 4 makes the stiffness of the cover plate 3 covering the second main surface S2 of the actuator substrate 2 higher than the stiffness of the nozzle plate 4 covering the first main surface S1.

The material of the cover plate 3 has preferably a Young's modulus, for example, not less than 40 GPa. The material of the nozzle plate 4 has preferably a Young's modulus, for example, in the range of 1.5 to 30 GPa. The nozzle plate 4 having a Young's modulus less than 1.5 GPa reduces the reliability because the nozzle plate 4 is easily scratched when contacting a recording medium. The nozzle plate 4 having a Young's modulus exceeding 30 GPa transfers the vibration to the ejection nozzle holes 11 and the dummy nozzle holes 18*a* and 18*b* adjoining to each other and thus facilitates a crosstalk.

Nozzle Guard

As illustrated in FIG. 3, the nozzle guard 25 is a component formed into a thin plate made of a metal material, for example, stainless steel. The nozzle guard 25 is formed into an approximately rectangle corresponding to the external forms of the actuator substrate 2 and the nozzle plate 4 when being viewed in the Z direction. The nozzle guard 25 has a thickness, for example, of about 0.2 mm.

As illustrated in FIG. 3, a slit 26 is formed on the nozzle guard 25 in the Y direction.

The slit 26 has a predetermined width in the X direction. For example, the X direction width of the slit 26 is much wider than the diameters of the ejection nozzle holes 11 and the dummy nozzle holes 18*a* and 18*b* that form the nozzle line 20. The nozzle line 20 is placed at the middle portion of the slit 26 in the X direction. The slit 26 has a predetermined length in the Y direction. Both of Y direction ends 26*a* and 26*b* are each formed into an approximate semi-circular arc bulging outward in planar view.

As illustrated in FIG. 5, the slit 26 of the nozzle guard 25 forms a stepped portion 27 having a height corresponding to the thickness of the nozzle guard 25 on the liquid ejection surface 4*a* of the nozzle plate 4. The stepped portion 27 is the −Z side surface 25*a* except for the slit 26 of the nozzle guard 25 and is placed at a position one level higher than the liquid ejection surface 4*a* of the nozzle plate 4 because of the thickness of the nozzle guard 25. The stepped portion 27 is configured to accumulate the liquid ejected from the ejection nozzle hole 11.

The Y direction length of the slit 26 is, for example, shorter than the Y direction length of the nozzle line 20. The −Y side end 26*a* of the slit 26 is placed at a position a predetermined distance away from the dummy nozzle hole 18*a* on −Y side in the nozzle line 20. The +Y side end 26*b* of the slit 26 is placed at a position a predetermined distance away from the dummy nozzle hole 18*b* on +Y side in the nozzle line 20. Thus, the nozzle guard 25 exposes the ejection nozzle holes 11 to the outside at the slit 26 and covers the dummy nozzle holes 18*a* and 18*b* in the nozzle line 20.

As illustrated in FIG. 5, for example, an outer edge on the +Z side surface 25*b* of the nozzle guard 25 is fixed and attached to the liquid ejection surface 4*a* of the nozzle plate 4 with an adhesive agent. This forms a slight gap in the area in which the nozzle plate 4 and the nozzle guard 25 do not adhere to each other with the adhesive agent between the nozzle plate 4 and the nozzle guard 25. The slight gap between the nozzle plate 4 and the nozzle guard 25 is a negative pressure chamber due to the suction of the dummy nozzle hole 18. The residual liquid in the stepped portion 27 enters the gap between the liquid ejection surface 4*a* of the nozzle plate 4 and the +Z side surface 25*b* of the nozzle guard 25 from the edge of the slit 26 so as to temporarily be accumulated in the gap. In other words, the nozzle guard 25 functions as a liquid storage unit for storing the residual liquid.

The liquid jet head 1 operates as follows. Refer to FIGS. 1 to 6 for the reference sign of each component in the following description of the operation of the liquid jet head 1.

Operating the pressurization pump 33*a* supplies liquid to the ejection channel 6*a* and the dummy channel 6*c* through the liquid supply pipe 35*a* and the liquid supply chamber 9, and operating the aspiration pump 33*b* discharges the liquid from the ejection channel 6*a* and the dummy channel 6*c* through the liquid discharge chamber 10 and the liquid discharge pipe 35*b*. This circulates the liquid between the liquid jet head 1 and the liquid tank 34.

Then, giving drive signals to the common terminal 16*a* and the active terminal 16*b* deforms a pair of wall portions 5 and 5 forming an ejection channel 6*a* by thickness shear deformation. At that time, the Z direction middle portion that is an area corresponding to the body portion 3*c* of the cover plate 3 between the wall portions 5 and 5 is bent and deformed, for example, toward the inside of the ejection channel 6*a*. This generates a pressure wave in the liquid in the ejection channel 6*a* and thus ejects the liquid from the ejection nozzle hole 11 communicated with the ejection channel 6*a*.

At that time, an electrode is not formed on the outer surface 2*d* of the outer wall 2A forming the dummy channel 6*c*. Thus, the outer wall 2A of the dummy channel 6*c* cannot be deformed by thickness shear deformation although a drive signal is given thereto. The outer wall 2A is incapable of driving. Thus, the liquid in the dummy channel 6*c* is not ejected from the dummy nozzle hole 18 and the liquid is maintained at a negative pressure.

The residual liquid that has not attach attached to the recording medium 44 in the liquid ejected from the ejection channel 6*a* is temporarily accumulated, for example, in the stepped portion 27 at the edge of the slit 26. In that case, the nozzle guard 25 is made of hydrophilic stainless steel. Thus, the residual liquid temporarily accumulated in the stepped portion 27 spreads and moves on the +Z side surface of the nozzle guard 25 so as to enter the gap between the liquid ejection surface 4*a* of the nozzle plate 4 and the +Z side surface 25*b* of the nozzle guard 25 and temporarily stored using the nozzle guard 25.

When the residual liquid stored using the nozzle guard 25 is aspirated from the dummy nozzle hole 18 into the dummy channel 6*c* when reaching the position overlapping with the dummy nozzle hole 18 on the +Z side surface 25*b* of the nozzle guard 25, namely, the position in which the dummy nozzle hole 18 can aspirate the residual liquid. The residual liquid aspirated into the dummy channel 6*c* is discharged outside the dummy channel 6*c* through the liquid discharge chamber 10 and the liquid discharge pipe 35*b* and is introduced into the liquid tank 34 so as to circulate between the liquid jet head 1 and the liquid tank 34.

Effect of First Embodiment

According to the present embodiment, the inside of the dummy channel 6*c* can be brought to a negative pressure because liquid having a negative pressure is supplied to the dummy channel 6*c*. Further, the residual liquid attaching to the nozzle plate 4 can be aspirated from the dummy nozzle holes 18 (18*a* and 18*b*) into the dummy channels 6*c* because the nozzle plate 4 includes the dummy nozzle holes 18 (18*a* and 18*b*) communicated with the dummy channels 6*c*, and the dummy nozzle holes 18 (18*a* and 18*b*) are placed at the positions in which the residual liquid stored using the nozzle guard 25 can be aspirated. This can prevent the liquid from remaining in the nozzle plate 4. This can prevent the defacement due to the residual liquid on the nozzle plate 4 and can stably jet the liquid.

Further, the inside of the dummy channel 6*c* can be brought to a negative pressure, similarly to the ejection channel 6*a* because the liquid jet apparatus includes the pressure adjustment unit 33 that adjusts the pressure such that the liquid supplied into the ejection channel 6*a* has a negative pressure, and the dummy channel 6*c* is communicated with the ejection channel 6*a* such that the liquid is supplied into the dummy channel 6*c*. Thus, a shared pressure adjustment unit 33 can bring the liquid in the ejection channel 6*a* and the dummy channel 6*c* to a negative pressure and then the residual liquid can be aspirated from the dummy nozzle holes 18 (18*a* and 18*b*) into the dummy channels 6*c*. This can produce, at a low cost, a liquid jet head 1 that can prevent the defacement due to the residual liquid on the nozzle plate 4 and can stably jet the liquid.

When the channel lines 6 are formed on the actuator substrate 2, the outer surfaces of the outer walls of the channels provided on both of the Y direction ends of the channel lines 6 are the outer surfaces 2*d* of the outer walls 2A of the actuator substrate 2 and are exposed to the outside of the actuator substrate 2. Thus, drive electrodes are not generally formed on the outer surfaces of the sidewalls of the channels provided on both of the Y direction ends of the channel lines 6. As a result, the channels provided at both ends of the channel lines 6 are incapable of driving. According to the present embodiment, designing conventionally existing channels that are incapable of driving as the dummy channels 6*c* can form the dummy channels 6*c* and the dummy nozzle holes 18 (18*a* and 18*b*) communicated with the dummy channels 6*c* without a complicated design change, process, or the like. This can produce, at a low cost, a liquid jet head 1 that can prevent liquid from remaining on the nozzle plate 4.

Designing the ejection nozzle holes 11 to have almost the same diameters as the diameters of the dummy nozzle holes 18 (18*a* and 18*b*) can form the ejection nozzle holes 11 and the dummy nozzle holes 18 (18*a* and 18*b*) in the same process. This can easily produce, at a low cost, a liquid jet head 1 that can prevent liquid from remaining on the nozzle plate 4.

Using the nozzle guard 25 as a liquid storage unit can prevent the damage to the liquid ejection surface 4*a* of the nozzle plate 4 and can store the residual liquid such that the residual liquid can be aspirated from the dummy nozzle holes 18 (18*a* and 18*b*) into the dummy channels 6*c*. This can produce a liquid jet head 1 that can prevent liquid from remaining on the nozzle plate 4 and is good in durability.

Providing the nozzle guard 25 so as to cover the dummy nozzle holes 18 (18*a* and 18*b*) can use the slight gap between the nozzle guard 25 and the nozzle plate 4 as a negative pressure chamber and can aspirate the residual liquid from the dummy nozzle holes 18 (18*a* and 18*b*). This can surely prevent liquid from remaining, especially, between the nozzle guard 25 and the nozzle plate 4.

Making the nozzle guard 25 of stainless steel can cause the residual liquid to spread and move on the surface of the nozzle guard 25. This can prevent liquid from remaining at the nozzle guard 25 and the nozzle plate 4 and can easily aspirate the residual liquid from the dummy nozzle holes 18 (18*a* and 18*b*) into the dummy channels 6*c*.

Making the nozzle plate 4 of a polyimide-based resin material can cause the residual liquid to easily move on the surface of the nozzle plate 4. This can prevent liquid from remaining on the surface of the nozzle plate 4 and can easily aspirate the residual liquid from the dummy nozzle holes 18 (18*a* and 18*b*) into the dummy channels 6*c*.

Placing each of the dummy nozzle holes 18 (18*a* and 18*b*) at the X direction middle portion of the dummy channel 6*c* can place each of the dummy nozzle holes 18 (18*a* and 18*b*) at the X direction middle portion on the nozzle plate 4. This can aspirate the residual liquid attaching to the surface of the nozzle plate 4 from the dummy nozzle holes 18 (18*a* and 18*b*) in a fine balance.

First Variation of First Embodiment

Figure 7:
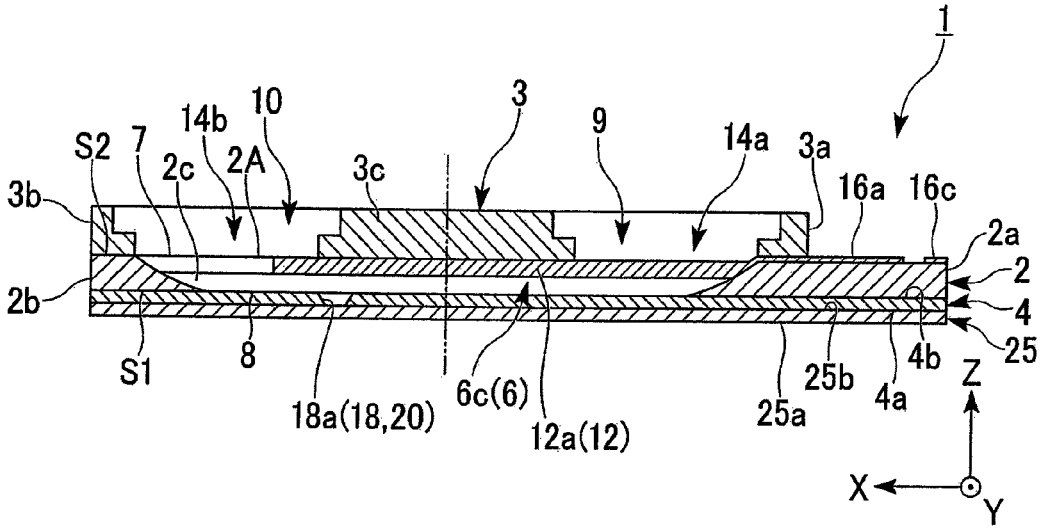
FIG. 7 is a diagram for describing a liquid jet head according to a first variation of the embodiment.

FIG. 7 is a diagram for describing a liquid jet head 1 according to a first variation of the first embodiment and a cross-sectional view of a dummy channel 6*c* taken along the X direction. Note that, for simplicity's sake, a drive electrode 12 is represented by hatching in FIG. 7.

Figure 8:
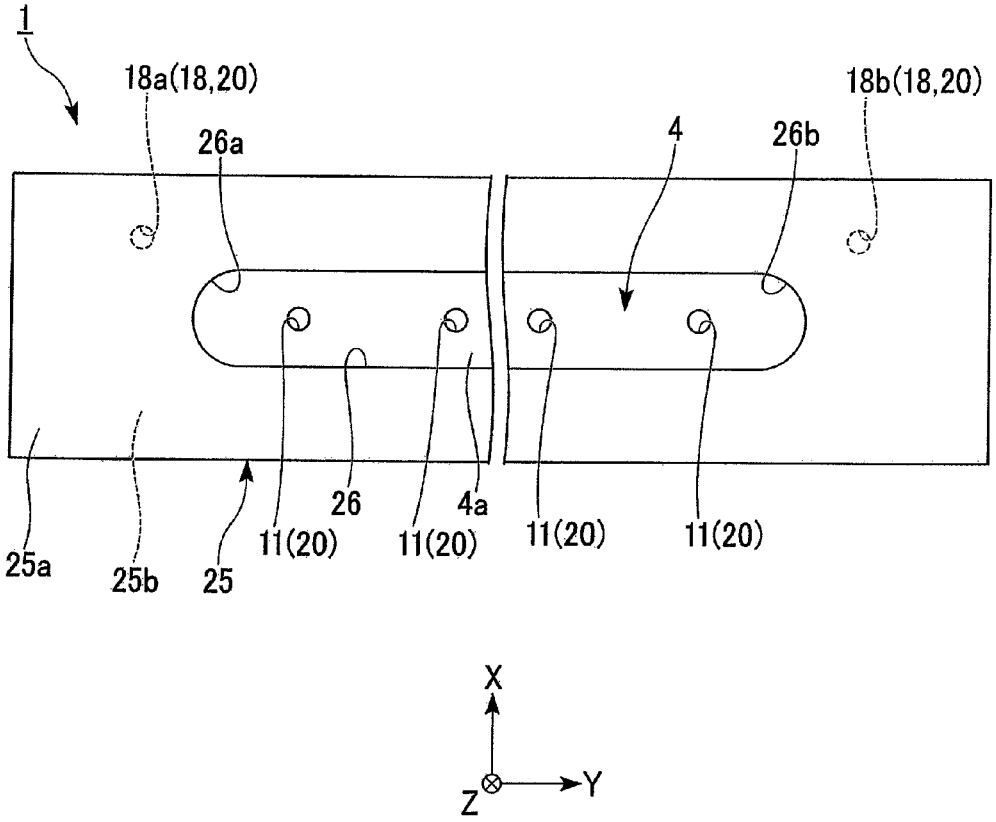
FIG. 8 is a diagram for describing the liquid jet head according to the first variation of the embodiment when being viewed from a −Z side.

FIG. 8 is a diagram for describing the liquid jet head 1 according to the first variation of the first embodiment when being viewed from a −Z side.

Subsequently, the liquid jet head 1 according to the first variation of the first embodiment will be described.

The liquid jet head 1 according to the first embodiment includes the dummy nozzle holes 18 communicated with the dummy channels 6*c* at the X direction middle portions of the dummy channels 6*c* (see FIG. 4C).

On the other hand, the liquid jet head 1 according to the first variation of the first embodiment is different as illustrated in FIG. 7 from the first embodiment in that the liquid jet head 1 includes dummy nozzle holes 18 communicated with the dummy channels 6*c* (FIG. 7 illustrates a dummy nozzle hole 18*a* on a −Y side) on a +X side away from the X direction middle portions of the dummy channels 6*c*. Note that the detailed descriptions of the same components as in the first embodiment will be omitted. Only different components will be described.

As illustrated in FIG. 7, the dummy channel 6*c* is communicated with an ejection channel 6*a* (see FIG. 4A). Thus, the liquid flowing in the dummy channel 6*c* is adjusted with a pressure adjustment unit 33 (see FIG. 2), similarly to in the ejection channel 6*a*, so as to constantly have a negative pressure near the dummy nozzle hole 18. Specifically, a pressurization pump 33*a* pressurizes the liquid flowing the ejection channel 6*a* and the dummy channel 6*c* so as to maintain the liquid at a positive pressure on a liquid supply chamber 9 side (on the −X side of the dummy channel 6*c*). The liquid is aspirated with an aspiration pump 33*b* so as to have a negative pressure on a liquid discharge chamber 10 side (on the +X side of the dummy channel 6*c*). To bring the liquid in the ejection channel 6*a* (see FIG. 4A) and the dummy channel 6*c* to a negative pressure, the suction of the aspiration pump 33*b* (see FIG. 2) is set higher than the pressurizing force of the pressurization pump 33*a* (see FIG. 2). Thus, forming the dummy nozzle hole 18 on the +X side away from the X direction middle portion places the dummy nozzle hole 18 near the aspiration pump 33*b*. This provides a higher suction than in the first embodiment.

As illustrated in FIG. 8, the dummy nozzle holes 18*a* and 18*b* are placed on the +X side away from a plurality of ejection nozzle holes 11 arranged in a row in the Y direction. The nozzle guard 25 is configured to expose the ejection nozzle holes 11 to the outside at a slit 26 and to cover the dummy nozzle holes 18*a* and 18*b* in a nozzle line 20.

Effect of First Variation of First Embodiment

A so-called flow-through type liquid jet head 1 causes the liquid to flow in the ejection channels 6*a* and the dummy channels 6*c* by bringing the liquid to a positive pressure on a supply side (the −X side) and bringing the liquid to a negative pressure on a discharge side (+X side) in the ejection channel 6*a* and the dummy channel 6*c*. According to the first variation of the first embodiment, placing the dummy nozzle holes 18*a* and 18*b* on the +X side away from the X direction middle portions of the dummy channels 6*c*, in other words, on the side on which the liquid at a negative pressure is discharged can provide a higher suction. This can surely aspirate the residual liquid from the dummy nozzle holes 18*a* and 18*b* into the dummy channels 6*c*.

Second Variation of First Embodiment

Figure 9:
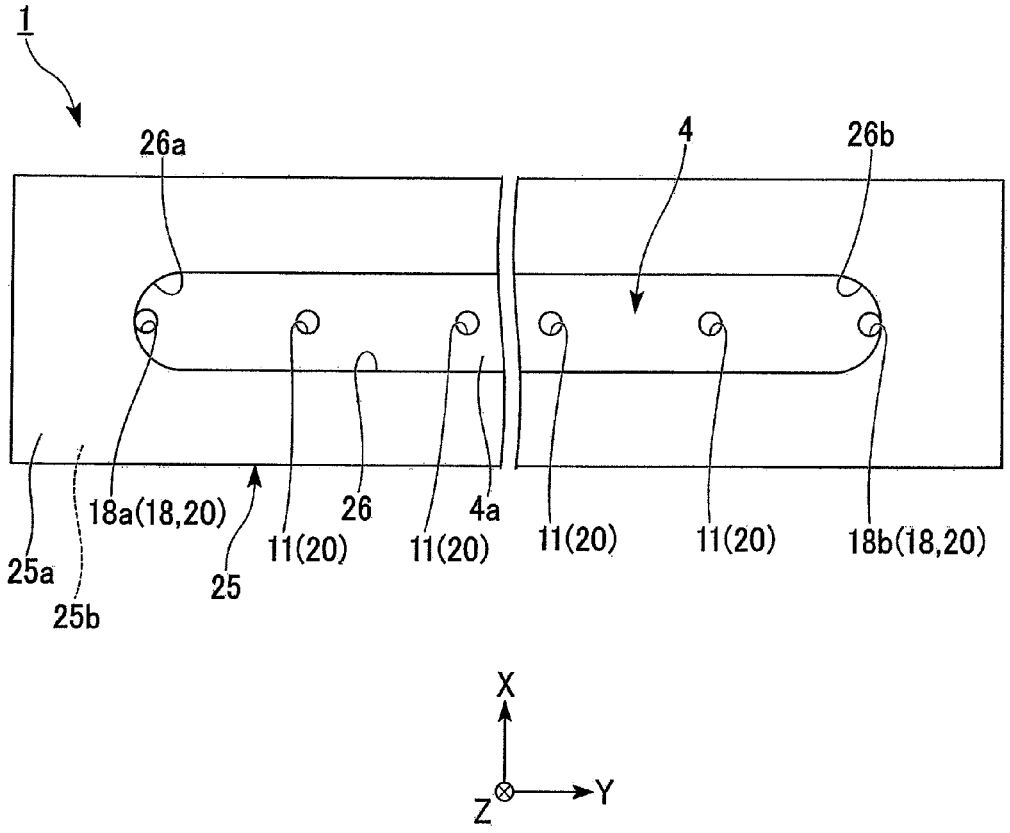
FIG. 9 is a diagram for describing a liquid jet head according to a second variation of the embodiment when being viewed from a −Z side.

FIG. 9 is a diagram for describing a liquid jet head 1 according to a second variation of the embodiment when being viewed from a −Z side.

Subsequently, the liquid jet head 1 according to the second variation of the first embodiment will be described.

According to the first embodiment, the nozzle guard 25 is configured to expose the ejection nozzle holes 11 at the slit 26 with covering the dummy nozzle holes 18*a* and 18*b* in the nozzle line 20 (see FIG. 6).

On the other hand, the liquid jet head 1 according to the second variation of the first embodiment is different as illustrated in FIG. 9 from the first embodiment in that the nozzle guard 25 exposes ejection nozzle holes 11 and dummy nozzle holes 18*a* and 18*b* to the outside at the slit 26, and edges of both ends 26*a* and 26*b* of the slit 26 are placed on edges of the dummy nozzle holes 18*a* and 18*b*. Note that the detailed descriptions of the same components as in the first embodiment will be omitted. Only different components will be described.

As illustrated in FIG. 9, the slit 26, for example, has almost the same length as a nozzle line 20 in the Y direction, and the edges of both ends 26*a* and 26*b* of the slit 26 are placed on the edges of the dummy nozzle holes 18*a* and 18*b*.

Effect of Second Variation of First Embodiment

According to the second variation of the first embodiment, placing the edges of the slit 26 of the nozzle guard 25 on the edges of the dummy nozzle holes 18*a* and 18*b* can surely aspirate the residual liquid attaching to the edges of the slit 26 of the nozzle guard 25 from the dummy nozzle holes 18*a* and 18*b*. This can surely prevent the liquid from remaining in the slit 26. Especially, a wiper (not illustrated in the drawings) that wipes the residual liquid with scanning through the liquid ejection surface 4*a* of the nozzle plate 4 causes the residual liquid wiped by the wiper to be likely to attach to the edges of the slit 26. Thus, the configuration according to the present variation in which the edges of the slit 26 of the nozzle guard 25 are placed on the dummy nozzle holes 18*a* and 18*b* is especially advantageous to a liquid jet head 1 including a wiper.

The configuration in which the dummy nozzle holes 18*a* and 18*b* are exposed at the slit 26 of the nozzle guard 25 can surely prevent the liquid from remaining in the slit 26 of the nozzle guard 25.

Second Embodiment

Figure 10:
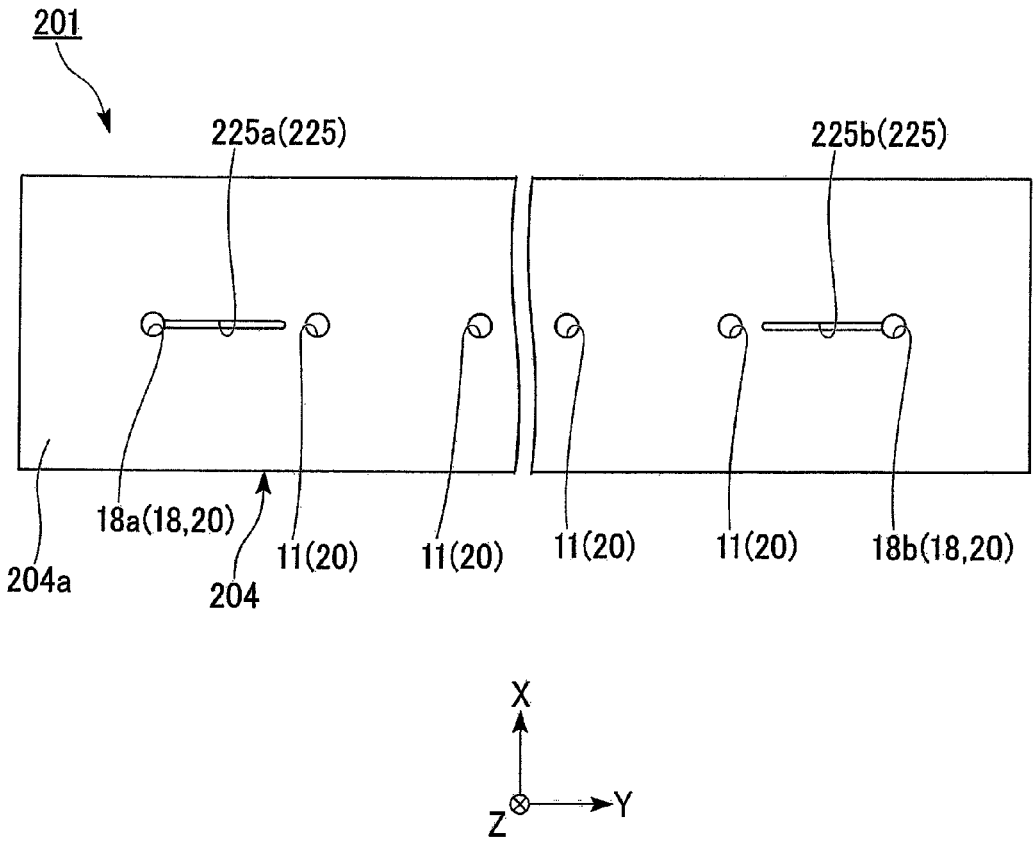
FIG. 10 is a diagram for describing a liquid jet head according to a second embodiment when being viewed from a −Z side.

FIG. 10 is a diagram for describing a liquid jet head 201 according to a second embodiment when being viewed from a −Z side.

Subsequently, the liquid jet head 201 according to the second embodiment will be described.

The liquid jet head 1 according to the first embodiment includes the nozzle guard 25 as a liquid storage unit (see FIG. 3).

On the other hand, the liquid jet head 201 according to the second embodiment is different as illustrated in FIG. 10 from the first embodiment in that the liquid jet head includes introduction grooves 225 as liquid storage units on a nozzle plate 204. Note that the detailed descriptions of the same components as in the first embodiment will be omitted. Only different components will be described.

The introduction grooves 225 having a predetermined depth that is deep enough to store the residual liquid are formed on a liquid ejection surface 204*a* of the nozzle plate 204. The introduction grooves 225 according to the present embodiment are provided at both of Y direction ends of a nozzle line 20 in the Y direction.

An introduction groove 225*a* on the −Y side is formed between a dummy nozzle hole 18*a* and an ejection nozzle hole 11 on the −Y side. A +Y side end of the introduction groove 225*a* is separated from the ejection nozzle hole 11 and a −Y side end of the introduction groove 225*a* is connected to the dummy nozzle hole 18*a* on the −Y side.

An introduction groove 225*b* on the +Y side is formed between a dummy nozzle hole 18*b* and an ejection nozzle hole 11 on the +Y side. A −Y side end of the introduction groove 225*b* is separated from the ejection nozzle hole 11 and a +Y side end of the introduction groove 225*b* is connected to the dummy nozzle hole 18*b* on the +Y side.

The residual liquid that has not attached to a recording medium 44 in the liquid ejected from the ejection nozzle holes 11 is temporarily accumulated and stored in the introduction grooves 225*a* and 225*b*. The residual liquid stored in the introduction grooves 225*a* and 225*b* is aspirated from the dummy nozzle holes 18 into dummy channels 6*c* when reaching the edges of the dummy nozzle holes 18, namely, a position in which the dummy nozzle holes 18 can aspirate the liquid. The residual liquid aspirated into the dummy channel 6*c* is discharged outside the dummy channel 6*c* through the liquid discharge chamber 10 and the liquid discharge pipe 35*b* and is introduced into the liquid tank 34 so as to circulate between the liquid jet head 1 and the liquid tank 34.

Effect of Second Embodiment

According to the second embodiment, using the introduction grooves 225 (225*a* and 225*b*) formed on the nozzle plate 204 as liquid storage units can provide the liquid storage units without using a new component. Using the introduction grooves 225 (225*a* and 225*b*) connected to the dummy nozzle holes 18 as liquid storage units can easily store the residual liquid and can surely cause the dummy nozzle holes 18 to aspirate the residual liquid.

Note that the technical scope of the present invention is not limited to the embodiments and can variously be changed without departing from the gist of the present invention.

A flow-through type liquid jet head 1 is cited as an example in the embodiments and the variations of the first embodiment. However, the application of the present invention is not limited to a flow-through type liquid jet head 1.

The positions in which the dummy nozzle holes 18 are formed, the number of the dummy nozzle holes 18, the shape of the openings of the dummy nozzle holes 18, and the like are not limited to the embodiments and the variations of the first embodiment, and can appropriately be set depending on the viscosity or amount of the ejected liquid, the suction of the dummy nozzle holes 18, the positional relationship between the ejection nozzle holes 11 and the dummy nozzle holes 18, or the like. Thus, for example, the dummy nozzle holes 18 and the ejection nozzle holes 11 that are alternately arranged can form the nozzle line 20.

In the embodiments and the variations of the first embodiment, communicating the ejection channel 6*a* with the dummy channel 6*c* causes the shared pressure adjustment unit 33 to adjust the pressure so as to maintain the liquid in each of the ejection channel 6*a* and the dummy channel 6*c* at a negative pressure. Alternatively, each of the ejection channel 6*a* and the dummy channel 6*c* can include an independent pressure adjustment unit so as to maintain the liquid in each channel at a negative pressure.

In the embodiments and the variations of the first embodiment, the channels provided at both of the Y direction ends of the channel lines 6 are designed as the dummy channels 6*c* that incapable of driving such that the residual liquid is aspirated from the dummy nozzle holes 18 (18*a* and 18*b*) communicated with the dummy channels 6*c*. However, the positions of the dummy channels 6*c* are not limited to the embodiments and the variations. For example, forming a predetermined channel that does not include a drive electrode among the channel lines 6 can provide the predetermined channel as a dummy channel incapable of driving at an arbitrary position among the channel lines 6.

In the embodiments and the variations of the first embodiment, each of the dummy nozzle holes 18 has almost the same diameter as the ejection nozzle holes 11. Alternatively, for example, each of the dummy nozzle holes 18 can have a larger or smaller diameter than the ejection nozzle holes 11. The diameter of each of the dummy nozzle holes 18 is appropriately set depending on the viscosity or amount of the ejected liquid, the suction of the dummy nozzle holes 18, the positional relationship between the ejection nozzle holes 11 and the dummy nozzle holes 18, or the like.

In the first embodiments and the first variation thereof, the slit 26 has a shorter length than the nozzle line 20 in the Y direction so as to expose the ejection nozzle holes 11 to the outside at the slit 26 and to cover the dummy nozzle holes 18*a* and 18*b*. In the second variation of the first embodiment, the slit 26 has, for example, almost the same length as the nozzle line 20 in the Y direction so as to expose the ejection nozzle holes 11 and the dummy nozzle holes 18*a* and 18*b* to the outside at the slit 26 and to place the edges of both end 26*a* and 26*b* of the slit 26 on the edges of the dummy nozzle holes 18*a* and 18*b*. However, the Y direction length of the slit 26 is not limited to the embodiments and the variations of the first embodiment. For example, the slit 26 can have a longer length than the nozzle line 20 in the Y direction so as to fully expose the ejection nozzle holes 11 and the dummy nozzle holes 18*a* and 18*b* at the slit 26. The Y direction length of the slit 26 is appropriately set depending on the viscosity or amount of the ejected liquid, the suction of the dummy nozzle holes 18, the positional relationship between the ejection nozzle holes 11 and the dummy nozzle holes 18, or the like.

In the embodiments and the first variation of the first embodiment, the X direction width of the slit 26 is much wider than the diameters of the ejection nozzle holes 11 and the dummy nozzle holes 18*a* and 18*b* that form the nozzle line 20, and at least the ejection nozzle holes 11 in the nozzle line 20 are placed at the X direction middle portion of the slit 26. Alternatively, the X direction width of the slit 26 can be, for example, almost the same as the diameters of the ejection nozzle holes 11 and the dummy nozzle holes 18*a* and 18*b* that form the nozzle line 20. This can place both of the X direction edges of the slit 26 on the edges of the openings of at least one of the ejection nozzle holes 11, and the dummy nozzle holes 18*a* and 18*b*. Especially, placing both of the X direction edges of the slit 26 on the edges of the openings of the dummy nozzle holes 18*a* and 18*b* in such a configuration can efficiently aspirate and remove the residual liquid accumulated at the X direction stepped portion of the slit 26 from the dummy nozzle holes 18*a* and 18*b*.

In the second embodiment, the nozzle plate 204 includes the introduction grooves 225 thereon as liquid storage units without being provided with the nozzle guard 25. Alternatively, the introduction grooves 225 as liquid storage units can be formed, for example, on one of the nozzle guard 25 and the nozzle plate 204 while the nozzle guard 25 is provided. An introduction groove can be provided as a second liquid storage unit on the nozzle guard 25 side while the introduction grooves 225 are provided as liquid storage units on the nozzle plate 204.

In the embodiments and the variations of the first embodiment, the ejection channels 6*a* and the non-ejection channels 6*b* that are alternately arranged in the Y direction, and the dummy channels 6*c* that are arranged on both of the Y direction ends one by one form the channel lines 6. The formation of the channel lines 6 is not limited to the formation in the embodiments and the variations. For example, it is not necessary to alternately arrange the ejection channels 6*a* and the non-ejection channels 6*b*. Channel lines 6 can include only ejection channels 6*a* and the dummy channels 6*c* without the non-ejection channels 6*b*. Alternatively, a plurality of the dummy channels 6*c* can be arranged at each of the Y direction ends. This can form a plurality of dummy nozzle holes 18 (18*a* and 18*b*) communicated with the dummy channels 6*c* on the nozzle plate 4 or 204. Thus, the residual liquid attaching to the nozzle plate 4 or 204 can be aspirated from a plurality of dummy nozzle holes 18 (18*a* and 18*b*) into the dummy channels 6*c*.

The material forming the nozzle plate 4 is not limited to a polyimide-based resin material. Alternatively, the surface of the nozzle plate 4 is rendered water-repellent. This can cause the residual liquid to easily move on the surface of the nozzle plate 4. Thus, the residual liquid can easily be aspirated from the dummy nozzle holes 18*a* and 18*b* into the dummy channels 6*c*.

Alternatively, the surface of the nozzle plate 4 is rendered hydrophilic. This can cause the residual liquid to spread and move on the surface of the nozzle plate 4. Thus, the residual liquid can easily be aspirated from the dummy nozzle holes 18*a* and 18*b* into the dummy channels 6*c*.

In addition, the components in the above-mentioned embodiments can properly be replaced with widely known components without departing from the gist of the present invention.

What is claimed is:

1. A liquid jet head comprising:

a nozzle plate having a nozzle line including a plurality of ejection nozzle holes;

an actuator substrate having channel lines including ejection channels communicated with the ejection nozzle holes;

a liquid storage unit configured to store residual liquid that attaches to the nozzle plate; and a pressure adjustment unit configured to adjust pressure so as to bring the liquid supplied into the ejection channels to a negative pressure, wherein the channel lines include a dummy channel that is incapable of driving, liquid is supplied into the dummy channel while being brought to a negative pressure, the nozzle plate includes a dummy nozzle hole communicated with the dummy channel, the dummy nozzle hole is placed at a position to aspirate the residual liquid stored in the liquid storage unit, and the dummy channel is communicated with the ejection channel such that the liquid is supplied into the dummy channel.

2. The liquid jet head according to claim 1, wherein a dummy channel is provided at both ends of the channel lines in a direction in which the channel lines are arranged.

3. The liquid jet head according to claim 2, wherein a plurality of the dummy channels are provided at each of the ends of the channel lines in a direction in which the channel lines are arranged.

4. The liquid jet head according to claim 1, wherein the dummy nozzle hole has almost an identical diameter to the ejection nozzle hole.

5. The liquid jet head according to claim 1, wherein the liquid storage unit is provided on a liquid ejection surface of the nozzle plate and constitutes a nozzle guard in which a slit configured to expose at least the ejection nozzle holes is formed.

6. The liquid jet head according to claim 5, wherein the nozzle guard is provided so as to cover the dummy nozzle hole.

7. The liquid jet head according to claim 5, wherein the slit of the nozzle guard is formed so as to expose the dummy nozzle hole.

8. The liquid jet head according to claim 7, wherein an edge of the slit of the nozzle guard is placed on an edge of the dummy nozzle hole.

9. The liquid jet head according to claim 5, wherein the nozzle guard is made of stainless steel.

10. The liquid jet head according to claim 1, wherein the liquid storage unit comprises an introduction groove formed on the nozzle plate and connected to the dummy nozzle hole.

11. The liquid jet head according to claim 5, further comprising a second liquid storage unit comprising an introduction groove formed on at least one of the nozzle plate and the nozzle guard, and connected to the dummy nozzle hole.

12. The liquid jet head according to claim 1, wherein the nozzle plate is made of a polyimide-based resin material.

13. The liquid jet head according to claim 1, wherein the liquid is supplied from a first longitudinal side of the dummy channel and is discharged from a second longitudinal side of the dummy channel so as to flow in the dummy channel, and the dummy nozzle hole is placed at a longitudinal middle portion of the dummy channel.

14. The liquid jet head according to claim 1, wherein the liquid is supplied from a first longitudinal side of the dummy channel and is discharged from a second longitudinal side of the dummy channel so as to flow in the dummy channel, and the dummy nozzle hole is placed on the second longitudinal side away from a longitudinal middle portion of the dummy channel.

15. The liquid jet head according to claim 1, wherein the channel lines include non-ejection channels alternately arranged with the ejection channels.

16. The liquid jet head according to claim 1, wherein a surface of the nozzle plate is rendered water-repellent.

17. The liquid jet head according to claim 1, wherein a surface of the nozzle plate is rendered hydrophilic.

18. A liquid jet apparatus, comprising: the liquid jet head according to claim 1; a moving mechanism configured to move the liquid jet head and a recording medium relative to each other; a liquid supply tube configured to supply liquid to the liquid jet head; and a liquid tank configured to supply the liquid to the liquid supply tube.

* * * * *